US008596021B2

(12) United States Patent
Van Ravenhorst

(10) Patent No.: US 8,596,021 B2
(45) Date of Patent: Dec. 3, 2013

(54) MODULAR BATHROOM WALL AND FLOOR SYSTEMS HAVING A PLURALITY OF ROOM CORNER SPRING CLIPS

(71) Applicant: Peter Van Ravenhorst, Boise, ID (US)

(72) Inventor: Peter Van Ravenhorst, Boise, ID (US)

(73) Assignee: Best Bath Systems, Inc., Caldwell, ID (US)

( * ) Notice: Subject to any disclaimer, the term of this patent is extended or adjusted under 35 U.S.C. 154(b) by 0 days.

(21) Appl. No.: 13/656,619

(22) Filed: Oct. 19, 2012

(65) Prior Publication Data

US 2013/0097944 A1 Apr. 25, 2013

Related U.S. Application Data

(60) Provisional application No. 61/549,186, filed on Oct. 19, 2011.

(51) Int. Cl.
*E04B 1/00* (2006.01)
*E04G 21/00* (2006.01)
*E04G 23/00* (2006.01)

(52) U.S. Cl.
USPC ..... 52/745.05; 52/34; 52/35; 52/741.1; 4/596; 4/612; 4/614; 4/613; 4/610

(58) Field of Classification Search
USPC ..... 52/34, 35, 741.1, 509, 36.1, 79.1, 52/741.13, 745.05; 4/663, 611, 613, 612, 4/614, 584, 596, 610, 600, 583; 403/329
See application file for complete search history.

(56) References Cited

U.S. PATENT DOCUMENTS

| | | | | | |
|---|---|---|---|---|---|
| 3,281,172 | A | | 10/1966 | Kuehl | |
| 3,688,459 | A | | 9/1972 | Mattix | |
| 3,789,568 | A | | 2/1974 | Mattix | |
| 3,811,241 | A | | 5/1974 | Mattix | |
| 3,870,388 | A | | 3/1975 | Lofgren | |
| 3,977,136 | A | | 8/1976 | Daniels | |
| 3,996,703 | A | * | 12/1976 | Daniels | 52/35 |
| 4,152,789 | A | * | 5/1979 | Heath | 4/614 |
| 4,299,064 | A | * | 11/1981 | Daniels | 52/35 |
| 4,316,295 | A | * | 2/1982 | Whitney et al. | 4/612 |
| 4,384,377 | A | | 5/1983 | Calvert | |
| 4,423,528 | A | * | 1/1984 | Wiedmeier | 4/613 |
| 4,901,380 | A | * | 2/1990 | Smith | 4/596 |
| 4,947,608 | A | * | 8/1990 | Donaldson et al. | 52/509 |
| 4,993,201 | A | * | 2/1991 | Bunyard | 52/35 |
| 5,115,604 | A | * | 5/1992 | Bunyard | 52/34 |
| 5,653,550 | A | * | 8/1997 | Mutz et al. | 403/329 |
| 5,983,583 | A | | 11/1999 | Mattix | |
| 6,405,491 | B1 | | 6/2002 | Gallant | |
| 6,425,147 | B1 | | 7/2002 | Hanson | |
| 6,698,037 | B2 | * | 3/2004 | Lippe | 4/612 |

(Continued)

*Primary Examiner* — Chi Q Nguyen
(74) *Attorney, Agent, or Firm* — Charles R. Clark

(57) ABSTRACT

The invention is a modular wall system and floor system for bathrooms, gang showers or any other room space having at least one generally 90 degree room corner with a first wall panel on one of the two intersecting room walls of said room corner intersecting and joining to a second wall panel on the other intersecting room wall. Each embodiment of the invention features a plurality of spring clips that together with a plurality of globs of adhesive form a room corner attaching means for wall panels or other wall members that intersect one another in a generally 90 degree room corner that provides a tight, closely abutting fit between the adjacent, perpendicularly intersecting panels or members in the room corner.

1 Claim, 12 Drawing Sheets

(56) References Cited

U.S. PATENT DOCUMENTS 7,028,349 B2 * 4/2006 Helmetsie et al. ..... 4/596
8,069,506 B2 * 12/2011 Hammond ..... 4/584
2008/0250558 A1 10/2008 Torres

* cited by examiner

MODULAR BATHROOM WALL AND FLOOR SYSTEMS HAVING A PLURALITY OF ROOM CORNER SPRING CLIPS

CROSS-REFERENCE TO RELATED APPLICATIONS

This application claims the benefit of U.S. Provisional Application No. 61/549186, filed Oct. 19, 2011.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, bathroom walls and floors are often fabricated of improved materials and utilizing novel systems that attempt to facilitate and ease the burden of building or installing such walls and floors. The present invention provides wall and floor systems for bathrooms and similar rooms that incorporate novel features as disclosed by the accompanying figures and this specification.

BRIEF SUMMARY OF THE INVENTION

The present invention provides several embodiments of a modular wall and floor system (UniWall™ system and UniFloor™ system) for bathrooms, gang showers and any space where water, liquids or humidity present maintenance and durability problems.

The embodiments of the invention system each feature a novel spring clip attaching means for wall panels and floor members in one or more selected generally 90 degree room corners that provides a tight, closely abutting fit between adjacent, perpendicularly intersecting panels and members in the room corner. This specification attempts to disclose the novel attaching means and methods of use of the attaching means during installation of selected wall panels and floor ledge members.

Each embodiment of the invention features wall panels, floor ledge members, and floor panels of durable, composite construction (laminated fiberglass reinforced plastic) that are water and chemical resistant, light weight, and strong (having a high strength-to-weight ratio).

Preferably, each composite wall panel and ledge member of the invention incorporates either a planar segmented plywood core or a one-piece core that allow attachment of rails, grab bars, and other fixtures without supplemental in-wall backing or reinforcements. The molded fiberglass and resin composite construction of the major components of the system provide a tough and highly impact resistant system. The gel coat surfaces of the components promote hygienic and sanitary conditions as the gel coat surfaces are shiny, smooth, and easy to clean. The panels and ledge members of the invention can be fabricated to have an attractive simulated tile pattern that is aesthetically pleasing.

The system provides an inventory of standardized wall panels, floor member ledges, and floor panels that use standardized molds during fabrication that help eliminate project specific molds and attendant tooling costs. The components are sized to be installed in a wide range of sizes of rooms having generally rectangular room walls and generally rectangular room floors and can be cut or trimmed during installation to fit a particular room or wall dimension.

Each embodiment of the invention incorporates selected basic wall panels, ledge members, floor pans, and shower pans; and the panels and ledge members selectively may be modified by an installer during field installation to allow convenient use of the invention in rooms of varying horizontal and vertical dimensions. In other words, a panel and a ledge member to be installed on a particular room wall can, if necessary, be cut to fit by an installer in the field to fit in selected 90 degree corners of the room without the need for additional corner trim members.

Wall panels incorporated into the invention can be added serially in both horizontal and vertical directions to dress one or more large generally rectangular walls with the panels and are preferably used with a generally rectangular floor assembly selected from among the following floor assemblies: (1) a selected molded one-piece floor pan; (2) a selected plurality of floor panels; (3) a selected shower pan joined to a selected plurality of floor panels, and joined to one or more selected floor ledge members; or (4) a preexisting floor; and a first wall panel and a second wall panel of the invention perpendicularly intersect in a selected 90 degree room corner with a wall panel attaching means that includes a plurality of S-shaped spring clips attached to a first wall panel side flange proximate to the selected room corner forming a clamping gap between the clips and a side end wall of said first panel; and said spring clips operatively act on an intersecting wall panel proximate a cut end edge of the second wall panel intersecting the first wall panel in the selected room corner with the cut end edge entering within the clamping gap and contacting the spring clips or the plurality of spring clips can be respectively attached to a plurality of angled brackets 74 that are attached to a selected framing member of the room in the selected room corner and operatively act on an adjacent wall panel proximate a selected cut end edge of the adjacent wall panel. See FIGS. 19 and 24*a* to 24*d*.

The invention incorporates a plurality of spring clips 70 in each of one or more selected room corners that during installation of adjacent perpendicularly intersecting wall panels make contact with backside portions of a respective selected wall panel or floor ledge member and are flexed from a rest condition to a flexed condition.

When in the flexed condition, the spring clips seek to return to the rest condition and exert a lateral pressure on the backside portion of the contacted wall panel towards and against the adjacent intersecting wall panel; the spring clip may exert lateral pressure under spring tension on the abutting surfaces of the intersecting panels clamping the abutting surfaces together.

During installation of the panels, a glob 76 of uncured construction adhesive (preferably a two-part anchoring epoxy adhesive) is interposed sized to substantially bridge between each spring clip 70 and an underlying support structure (corner wall studs of the room or angled brackets 72 attached to said studs) and the abutting relationship of the adjacent perpendicularly intersecting panels in the selected corner is generally locked after installation by a curing without significant shrinkage or shape changing of each glob of construction adhesive into a durable, generally rigid mass that immobilizes the associated contacted spring clip locking it in a fixed planar position that will maintain the tight joint achieved by the lateral pressure applied by the spring clip and thereby provides a stable, tight joint between the intersecting panels.

During the installation process and until the globs 76 of applied construction adhesive cure, the spring clips 70 of the invention can be flexed and thereby accommodate construction variables such as shifting of panels or ledges relative to adjacent panels or ledges by providing a spring-loaded, floating corner joint, therefore lessening any perceived need for a perfectly plumb room framing. The invention also helps overcome fabrication processes that result in some wall panels being somewhat out of true and somewhat bowed in their central body outer surface that is not as planar as another wall panel and the invention lessens the effect that the bowing may have on the tightness of the corner joints in a room corner that utilize the invention's mechanism of spring clips and globs of construction adhesive by pressuring a bowed cut edge to a truer flatter abutting surface to contact the adjacent wall panel.

The UniWall™ system invention incorporates a set of molded fiberglass reinforced plastic wall panels each having a gel coat finish with a molded-in simulated tile pattern. Preferably, the system incorporates a plurality of lower wall panels and upper wall panels with each wall panel being approximately 38 inches high and 96 inches long. Each wall panel is fabricated having a planar segmented plywood core sandwiched between two resin and glass fiber laminate layers yielding a panel that is preferably and approximately one half inch thick in the central generally planar body of the panel. Each wall panel is fabricated having turned edges and attachment flanges on all sides except at the bottom that offset the central body outer surface preferably and approximately 1¼ inches off-set at the edges. Preferably, the ends and top of each wall panel has an approximately eighth of an inch thick flange that can be attached to the wall framing of the room or be selectively cut off and removed by an installer during field installation of the invention.

Each time a room wall exceeds a 96 inches width or length, then a plurality of wall panels serially will be abutted end to end with their respective proximate side flanges removed and their side faces in abutting contact with a plurality of panel aligning retainers 60 mounted in one respective panel end cooperating with a corresponding plurality of aligning side retainer bores 56 in the facing abutting end of the adjacent panel along the room wall. There may be a selective need for a stringer (a horizontal piece of framing between two vertical studs) away from the room corners to provide support for the opposite, "floating" end of a wall panel for the end of the panel away from the room corner.

Unless there is going to be only one course of wall panels installed in a room, i.e. where a wainscoting is required, a top outer face of each wall panel may have a plurality of aligning retainers 60 (tapered pins). These retainers facilitate the use of additional wall panels above having respective corresponding and cooperating retainers aligning vertical retainer bores 58 in their bottom outer faces for these retainers to slip into and thereby align and secure adjacent wall panels relative one to the next above adjacent wall panel in the plane of the wall. The invention allows for adding serially end to end an unlimited number of wall panels until a room corner is approached and encountered.

Additional and various other objects and advantages attained by the invention will become more apparent as the specification is read and the accompanying figures are reviewed.

DETAILED DESCRIPTION OF THE INVENTION

Referring to FIGS. 1 through 30*c*, the present invention is an improved modular bathroom wall and floor system preferably made primarily of molded gelcoat fiberglass reinforced plastic panel construction for installation into an unfinished bathroom or shower room or other room.

Elements of a plurality of embodiments of the system of the invention are disclosed in FIGS. 1 through 30*c*.

Figure 1:
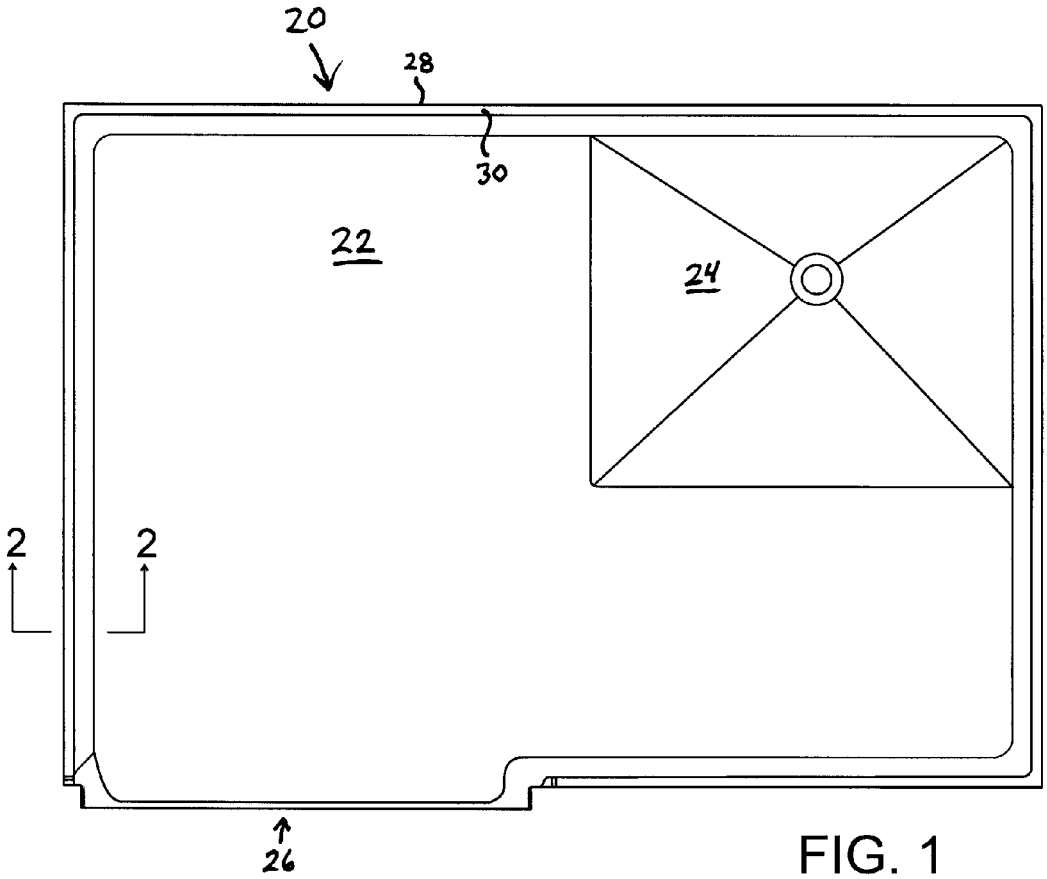
FIG. 1 is a top plan view of a molded one-piece floor pan 20 having a general floor portion 22, an integral shower pan portion 24, a doorway threshold portion 26, a room perimeter wall mounting flange 28, and a panel receiving shelf 30 (preferably angled), and a shelf reinforcing core 32.
Figure 2:
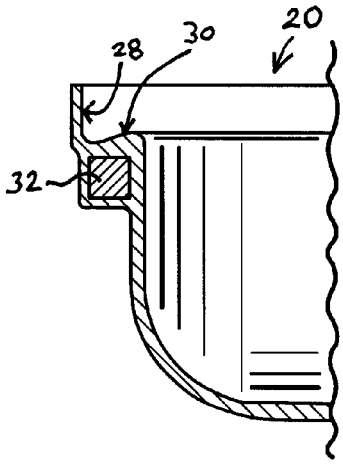
FIG. 2 is a cross-sectional view of the molded one-piece floor pan 20 as viewed in direction 2-2 in FIG. 1 and showing a shelf reinforcing core 32.
Figure 3:
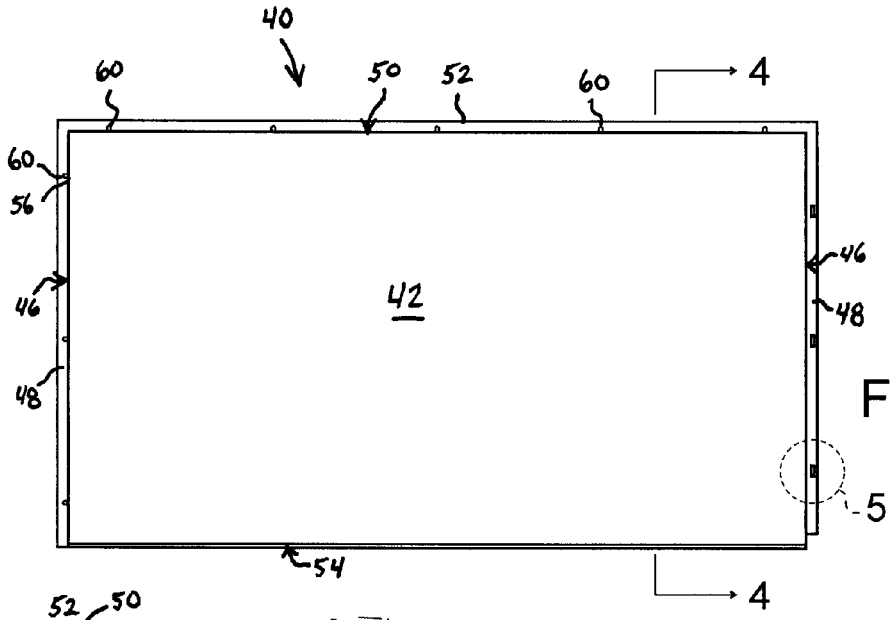
FIG. 3 is a front plan view of a lower wall panel 40 having a generally planar lower panel central body outer surface 42, a generally planar lower panel central body inner surface 43 (not shown in FIG. 3; see FIG. 4), two spaced and parallel lower panel side end walls 44 (see FIG. 4) each end wall having a side end face 46, two spaced and coplanar lower panel side flanges 48, a horizontal top outer face 50, a lower panel top flange 52, a bottom outer face 54, and a bottom inner face 55 (see FIG. 4), and showing a plurality of panel aligning retainers 60 distributed along the top outer face and along one of the side end faces at one lower panel end, and showing a plurality of S-shaped spring clips 70 attached to and distributed along the side flange at the opposite lower panel end; preferably the side flanges and top flange are coplanar.
Figure 4:
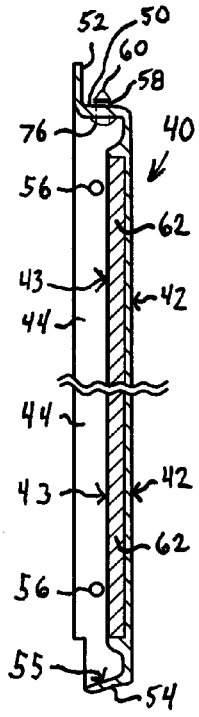
FIG. 4 is a cross-sectional view of the lower wall panel 40 as viewed in direction 4-4 in FIG. 3 showing the side end wall 44 having a plurality of side retainer bores 56, showing the generally horizontal top outer face 50 having a vertical retainer bore 58 having an aligning retainer 60 mounted and secured within said bore by a sufficient glob 76 of construction adhesive, showing a bottom outer face 54, and showing a reinforcing core 62 (in a best embodiment of the invention, the core comprises a checkerboard-like close array of a plurality of generally coplanar and generally rectangular laminated wood segments)
Figure 5:
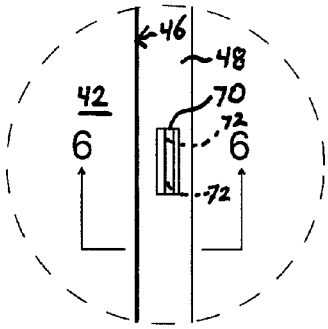
FIG. 5 is an enlarged view of an indicated portion 5 of FIG. 3 showing an S-shaped spring clip 70 attached to a lower panel side flange 48.
Figure 6:
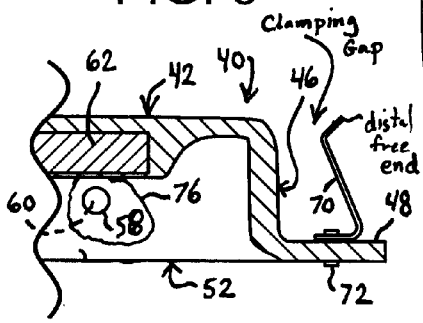
FIG. 6 is a partial, cross-sectional view of the lower wall panel 40 as viewed in direction 6-6 in FIG. 5 showing a reinforcing core 62 and showing the S-shaped spring clip 70 attached to a side flange 48 by a pop rivet 72 and the horizontal axis of the spring clip cental web aligned parallel to the side end face 46 and coaxial to the other spring clips (shown in FIG. 3) mounted to the side flange and the spring clip distal free end away from and selectively spaced from the side end face; and showing the spring clip angled towards the side end face and defining a clamping gap between the spring clips and the end face.
Figure 7:
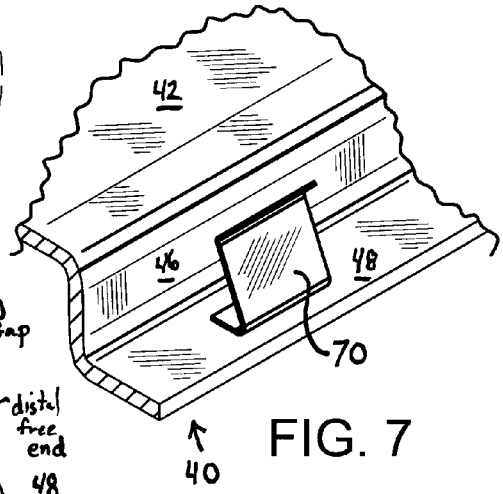
FIG. 7 is a partial, perspective view from a lower front corner of the wall panel 40 shown in FIG. 3.
Figure 8:
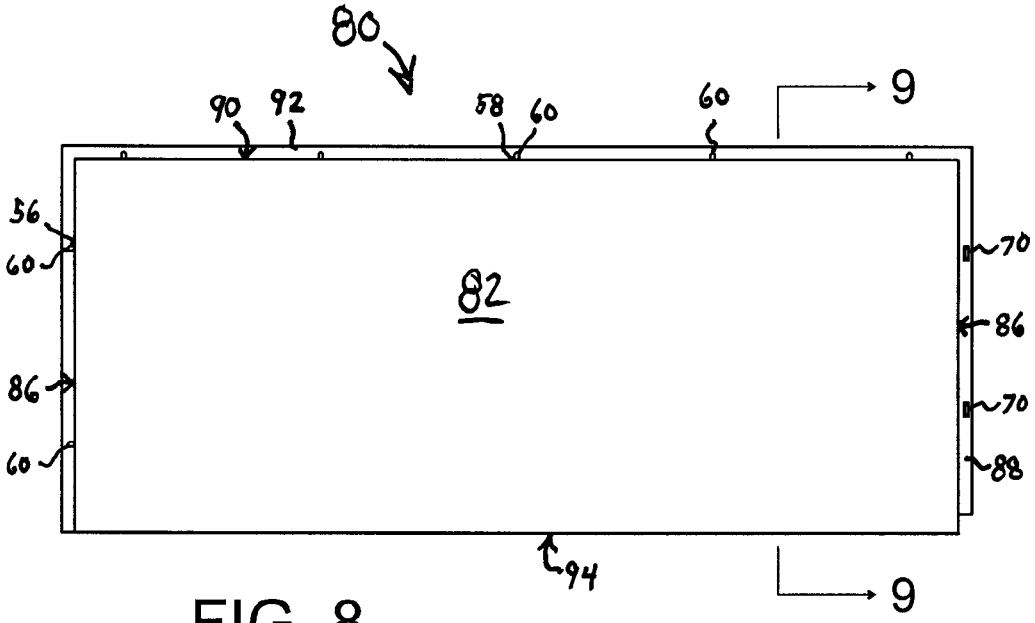
FIG. 8 is a front plan view of an upper wall panel 80 having a generally planar upper panel central body outer surface 82, a generally planar upper panel central body inner surface 83 (not shown in FIG. 8; see FIG. 9), two spaced and parallel upper panel side end walls 84 (see FIG. 9) each end wall having a side end face 86, two spaced and coplanar upper panel side flanges 88, a generally horizontal top outer face 90, an upper panel top flange 92, a generally horizontal bottom outer face 94, and a bottom inner face 96 (see FIG. 9); and showing a plurality of panel aligning retainers 60 distributed along the top outer face and along one of the side end faces at one upper panel end, and showing a plurality of S-shaped spring clips 70 attached to and distributed along the side flange at the opposite upper panel end; preferably the side flanges and top flange are coplanar.
Figure 9:
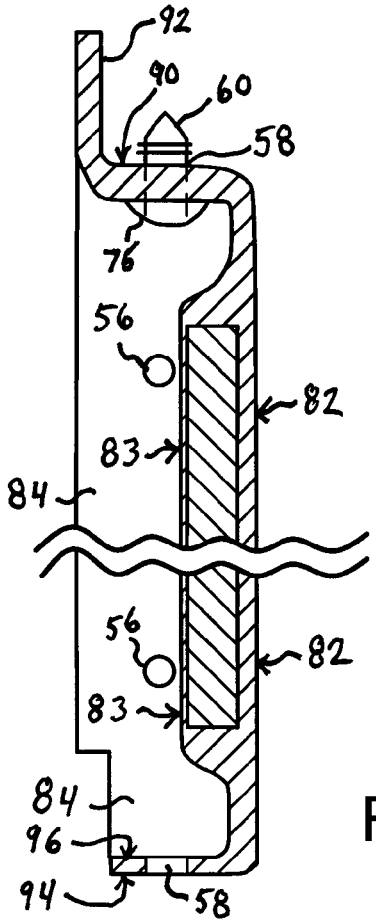
FIG. 9 is a cross-sectional view of the upper wall panel 80 as viewed in direction 9-9 in FIG. 8 showing the side end wall 84 having a plurality of side retainer bores 56, showing a generally horizontal top outer face 90 having a vertical retainer bore 58 having an aligning retainer 60 mounted and secured within said bore by a sufficient glob 76 of construction adhesive, showing a generally horizontal bottom outer face 94 having a vertical retainer bore 58; and showing a reinforcing core 62 (in a best embodiment of the invention, the core comprises a checkerboard-like close array of a plurality of generally coplanar and generally rectangular laminated wood segments)
Figure 10:
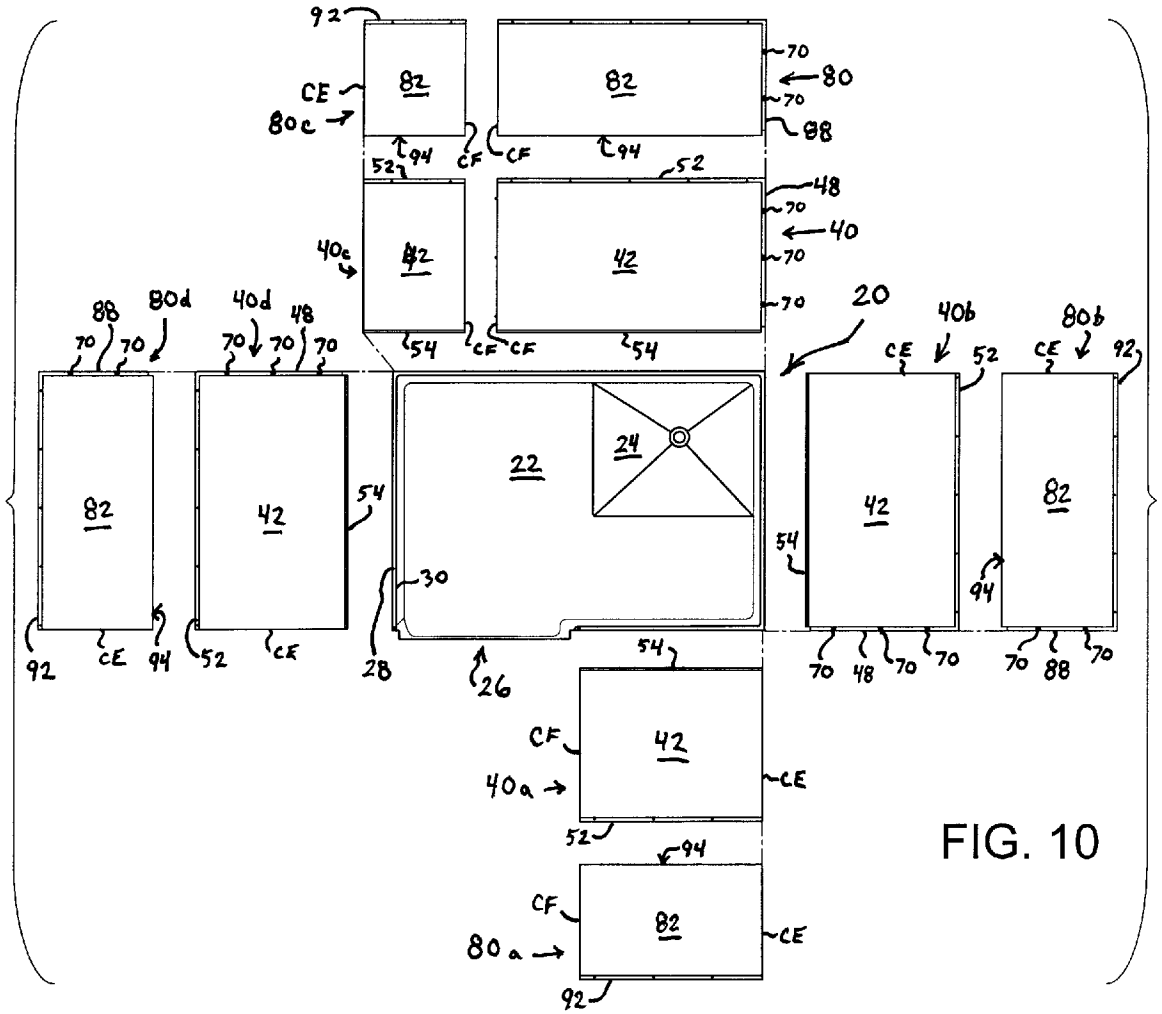
FIG. 10 is a laid-out-flat exploded view of a best embodiment of a wall and floor system having a molded one-piece floor pan 20 and showing the floor pan, a plurality of lower wall panels 40, 40*a* to 40*d*, and a plurality of upper wall panels 80, 80*a* to 80*d* (throughout the FIGS., reference indicia CE indicate a transverse cut end edge; and reference indicia CF indicate a transverse cut side flange along a respective side end face)
Figure 11:
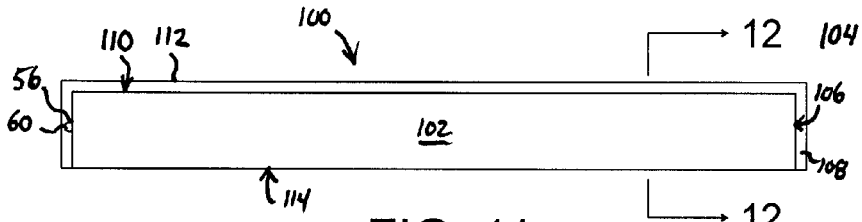
FIG. 11 is a front plan view of a floor ledge member 100 having a ledge member central body outer surface 102, a ledge member central body inner surface 103 (not shown in FIG. 11; see FIG. 12), two ledge member end walls 104 (see FIG. 12), two ledge member end faces 106, two spaced and coplanar ledge member side flanges 108, a ledge member shelf 110, a floor ledge member top flange 112, a ledge member bottom outer face 114, selectively having an aligning retainer 60 proximate to a middle portion of one of the member end faces, and a ledge member reinforcing core 116 (see FIG. 12)
Figure 12:
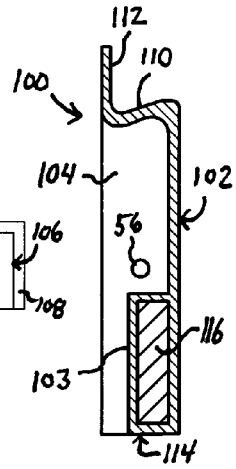
FIG. 12 is a cross-sectional view of the floor ledge member 100 as viewed in direction 12-12 in FIG. 11 showing a ledge member central body inner surface 103, a ledge member end wall 104 having a retainer receiving bore 56 placed to selectively cooperate with a corresponding aligning retainer of a next adjacent floor ledge member, a ledge member bottom outer face 114, and a ledge member reinforcing core 116.

FIG. 10 is a laid-out-flat exploded view of a best embodiment of a wall and floor system having a molded one-piece floor pan 20 and showing a plurality of lower wall panels 40, 40*a* to 40*d*, a plurality of upper wall panels 80, 80*a* to 80*d*, the wall panels 40 and 80 each having a respective side flange at the end away from the plurality of spring clips 70 cut away to permit their side end faces to abut the side end faces of the adjacent wall panels 40*c* and 80*c* and the other wall panels are cut at one or both ends by an installer as needed during the installation process.

Referring to FIG. 10, in a best embodiment, a method of practicing the invention for installing a plurality of generally rectangular wall panels in a selected generally rectangular room having four room walls and a room doorway proximate a first room corner comprises the following steps:

(1) select and install in said room a generally rectangular molded one-piece floor pan 20 floor assembly; said floor assembly having an outer perimeter having a doorway threshold 26 located proximate said first room corner and having a coplanar panel receiving shelf 30 proximate an inner perimeter of said room adjacent said room walls commencing proximate said first room corner and to the left of said doorway threshold and proceeding along all four sides of said inner perimeter and ending proximate to the right of said doorway;

(2) evaluate a first room wall to the left of said doorway threshold and determine the number of said wall panels 40 needed to provide a course of wall panels serially end to end on said first room wall from said first room corner to a second room corner, and in a case shown in FIG. 10, less than a full-length wall panel of the invention is needed;

(3) select a first wall panel having a left end having a left side flange and a right end having a right side flange and measure for fit on said first room wall and in said case, the panel being too long for said first room wall, said first wall panel left end selectively is transversely cut to fit said first wall panel 40*d* to said first room wall; said first wall panel having a first plurality of spring clips 70 attached to said right side flange 48 forming a first clamping gap; then place said first wall panel in said panel receiving shelf positioned between said first room corner and said second room corner with said first plurality of spring clips proximate said second room corner and attach said first wall panel attached with a plurality of panel mounting screws 53 to said first room wall;

(4) evaluate a second room wall to the right of said second room corner and determine the number of said wall panels needed to provide a first course of wall panels serially end to end on said second room wall from said second room corner to a third room corner, and in said case shown in FIG. 10, approximately one and a third wall panels are needed;

(5) select a second wall panel and a third wall panel each said wall panel having a left end having a left side flange and a right end having a right side flange and measure for fit on said second room wall and in said case shown in FIG. 10, the two panels end to end being too long for said second room wall, said left side flange of said third wall panel selectively is transversely cut off to fit and said third wall panel 40 having a second plurality of spring clips attached to said third wall panel right side flange forming a second clamping gap; then place said third wall panel in said panel receiving shelf positioned between said second room corner and said third room corner with said second plurality of spring clips proximate said third room corner and attach said third wall panel with a plurality of panel mounting screws to said second room wall; said right side flange of said second wall panel is transversely cut off and said left end of said second wall panel selectively is transversely cut forming a second panel left cut edge to fit said second wall panel 40*c* to said second room wall between said second room corner and said third wall panel;

(6) deposit a plurality of globs 76 of construction adhesive operatively and respectively behind each of the first plurality of spring clips; then (7) place said second wall panel in said panel receiving shelf with said second panel left cut edge positioned to cooperate and engage said first plurality of spring clips within said first clamping gap; and attach said second wall panel positioned between said second room corner and said third wall panel and said second wall panel with a plurality of panel mounting screws 53 to said second room wall;

(8) Evaluate a third room wall to the right of said third room corner and determine the number of said wall panels needed to provide a first course of wall panels serially end to end on said third room wall from said third room corner to a fourth room corner, and in said case shown in FIG. 10, less than a full-length fourth wall panel is needed;

(9) select a fourth wall panel having a left end having a left side flange and a right end having a right side flange and measure for fit on said third room wall and in said case shown in FIG. 10, the panel being too long for said third room wall, said fourth wall panel left end selectively is transversely cut forming a fourth panel left cut edge to fit said fourth wall panel 40*b* to said third room wall between said third room corner and said fourth room corner;

(10) deposit a plurality of globs 76 of construction adhesive operatively and respectively behind each of the second plurality of spring clips; then

(11) place said fourth wall panel in said panel receiving shelf with said fourth panel left cut edge positioned to cooperate and engage said second plurality of spring clips within said second clamping gap; and attach said fourth wall panel positioned between said third room corner and said fourth room corner with a plurality of panel mounting screws to said third room wall;

(12) Evaluate a fourth room wall to the right of said fourth room corner and determine the number of said wall panels needed to provide a first course of wall panels serially end to end on said fourth room wall from said fourth room corner to a right side of said doorway, and in said case shown in FIG. 10, less than a full-length fourth wall panel is needed;

(13) select a fifth wall panel having a left end having a left side flange and a right end having a right side flange and measure for fit on said fourth room wall and in said case shown in FIG. 10, the panel being too long for said fourth room wall, said fifth wall panel left end selectively is transversely cut forming a fifth panel left cut edge to fit said fifth wall panel 40*a* to said fourth room wall between said fourth room corner and said right side of said doorway;

(14) deposit a plurality of globs 76 of construction adhesive operatively and respectively behind each of the third plurality of spring clips; then

(15) place said fifth wall panel in said panel receiving shelf with said fifth panel left cut edge positioned to cooperate and engage said third plurality of spring clips within said third clamping gap; and attach said fifth wall panel positioned between said fourth room corner and said right side of said doorway; and

(16) selectively repeat steps (1) through (16) regarding each additional course of wall panels selected to be installed in the room until a last wall panel of the a last course of wall panels is attached to one of said room walls.

Preferably, when the UniWall™ system is used with an existing room floor or a UniFloor™ system floor, the bottom outer face of the lowest course of wall panels are aligned approximately an eighth of an inch off the floor surface and a bead of adhesive/sealant is placed to bridge between the floor surface and each bottom outer face of the lowest wall panels thereby allowing for differences in expansion and contraction of dissimilar materials and allowing for any seismic movement.

Figure 29:
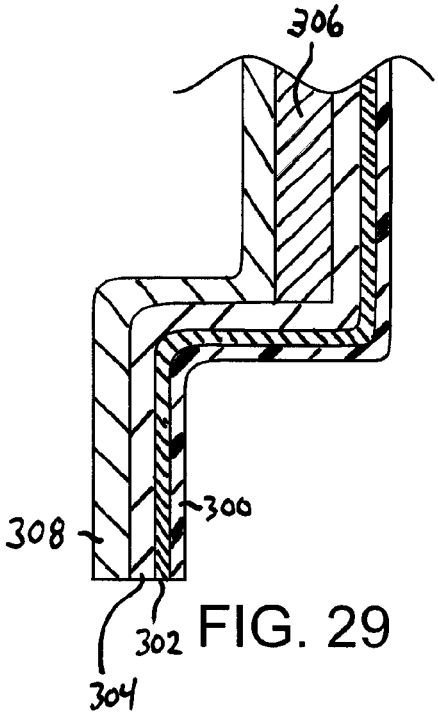
FIG. 29 is a representative partial cross-sectional view of a wall panel or a floor ledge member showing the layers 300, 302, 304, 306, 308 of the panel or ledge member.
Figure 30A:
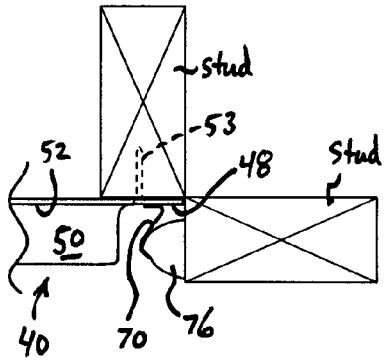
FIG. 30*a* is a partial, top plan view of a representative 90 degree corner of a room having an embodiment of the invention installed and showing a wall panel 40 having an S-shaped spring clip 70 attached forming a clamping gap awaiting insertion of a cut end of a perpendicular and intersecting wall panel into the clamping gap defined by the spring clip and the side end face 46 and showing a glob 76 of a sufficient quantity of uncured construction adhesive substantially bridging between the spring clip and a wall stud of the corner of the room.
Figure 30B:
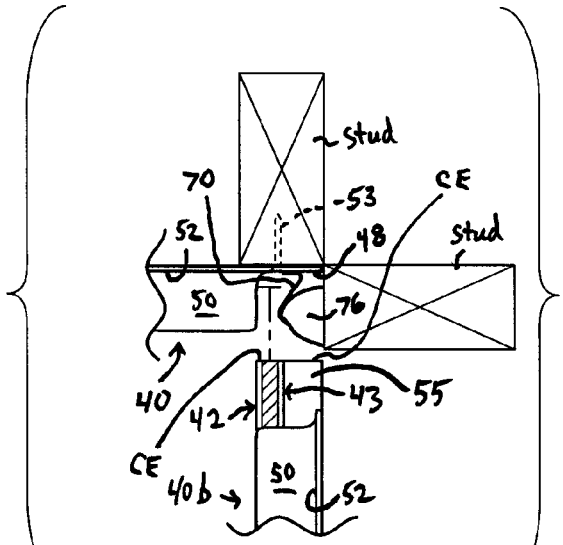
FIG. 30*b* is a partial, cutaway, exploded top plan view of the representative 90 degree corner shown in FIG. 30*a* showing two wall panels before being abutted and joined one to another by the spring clip and showing a glob of sufficient quantity of uncured construction adhesive substantially bridging between the spring clip and a stud of the corner of the room and showing with a lead line the intended insertion path of one of the wall panels into the clamping gap.
Figure 30C:
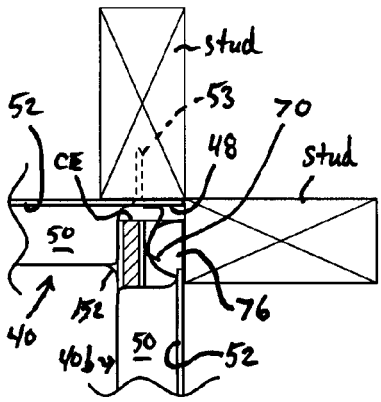
FIG. 30*c* is a partial, cutaway, top plan view of the representative 90 degree corner shown in FIG. 30*a* after the two panels are abutted one to another by the spring clip and showing a glob 76 of a sufficient quantity of cured construction adhesive substantially bridging between the spring clip and a stud of the corner of the room and fixing the spring clip and clamped wall panel in position.

Referring to FIG. 29, preferably each wall panel including each inside corner wall panels and each ledge member including each inside corner ledge member of the invention is fabricated using a respective selected fabrication mold that receives the following layers in sequence:

a gel coat surface layer 300;

a barrier coat layer 302;

a first resin and glass fiber laminate layer 304;

a reinforcement core 306; preferably a laminated wood core, and a second resin and glass fiber laminate layer 308.

The invention in the various embodiments incorporates a selected plurality of molded gel coated fiberglass reinforced elements that are joined one to the next adjacent element preferably by a primary joint seal that preferably is a two-part methacrylate surfacing adhesive that provides a hard, permanent, durable primary joint seal 150. The embodiments of the invention selectively may incorporate secondary joint seals 154 as appropriate and as selected and applied by a reasonably skilled installer and can include a flexible silicone caulk.

The invention in its best embodiment uses a plurality of globs 76 of a two-part anchoring epoxy adhesive and the invention relative to the spring clips may use other suitable construction adhesives that cure (harden) without significant shrinkage or changing of shape to a durable, generally rigid mass that preferably is water-resistant.

Aligning retainers 60 can be anchored in retainer bores 56, 58 using a polyester body putty such as the Bondo brand or another suitable body putty filler or other construction adhesives or other adhesives known in the art. The fiberglass bathroom floor panels, the floor pans, and shower pans of the various embodiments of the invention preferably can be joined to an underlying subfloor in a room receiving an installation of the system of the invention by a suitable anchoring epoxy adhesive 154 or other suitable adhesive.

Flanges and brackets of the invention are attached to room walls or room framing with suitable panel mounting screws 53, nails, staples, or other suitable fastening devices known in the art. Pop rivets 72 or other suitable fastening means may be used to secure the spring clips 70 to underlying side flanges or to underlying angled brackets 74.

The wall attachment means for two intersecting wall panels in a selected 90 degree room corner utilizes a plurality of spring clips 70 attached to either one of the wall panels or to the room corner surface or room corner framing and a respective plurality of globs 76 of sufficient respective quantities of uncured construction adhesive interposed to substantially bridge between said spring clips and the room corner structure establishing a relationship with said spring clips and the cut panel is attached to the first room wall, and said clips provide lateral force to the backside of the cut panel to push the abutting panels tightly together in the room corner.

Another illustration of the installation of a UniWall™ wall system involves a room having a steel door frame, regarding this installation: a first wall panel can be angled in behind the edge for a slight overlap and a wedge inserted from the backside to force the first wall panel tight to the steel door frame, then one or more wall panels are then serially attached end to end to the first room wall or first room wall framing until a first room corner (perpendicularly intersecting second room wall or second room wall framing) is approached, then the next wall panel progressing to the first room corner is cut to preferably come within approximately three-eighths of an inch of the surface of the intersecting second room wall or of the intersecting room framing, then a wall panel having a flange and attached a plurality of spring clips 70 is attached to the second room wall with the flange having the spring clips proximate to the first room corner, then a plurality of globs 76 of sufficient respective quantities of uncured construction adhesive is interposed to bridge between said spring clips and said adjacent first room corner structure, then said cut edge is slipped into a clamping gap (a spring tensioned contact zone) of the second wall panel establishing a relationship with said spring clips and the cut panel is then attached to the underlying room wall, and said clips provide lateral force to the backside of the cut panel to push the abutting panels tightly together in the first room corner.

The UniFloor™ system of the invention incorporates a plurality of flat molded fiberglass reinforced plastic panels each having a textured, slip-resistant gel coat finish. Preferably, the floor panels are approximately 48 inches wide, 96 inches long, and one quarter to one and three eighths of an inch thick. The floor panels have radiused edges that can abut to adjacent adjoining panels and during installation the floor panels are placed checker-board fashion closely abutting one another to cover the room floor and the abutting edges are sealed together with an appropriate joining sealant. The floor panels can be glued to the room floor with an appropriate adhesive such as a two-part anchoring epoxy. When a floor panel is cut to fit a room, the cut edge preferably is aligned along the room perimeter.

The UniWall™ system can be installed directly onto a UniFloor™ invention or any other room floor and sealed to the floor structure with a variety of sealants.

When a molded shower pan 122 is installed in a room either along a room wall or in a room corner, the shower pan will generally have a shower pan shelf 126 spaced upward and parallel from the general horizontal plane of the underlying room floor and parallel and along one or more adjacent lower wall panels 40 and the shower pan preferably will have a shower pan room perimeter mounting flange 128 along the outer upper perimeter of the shower pan adjacent the room wall or room corner surfaces and adjacent along the shower pan shelf.

Figure 13:
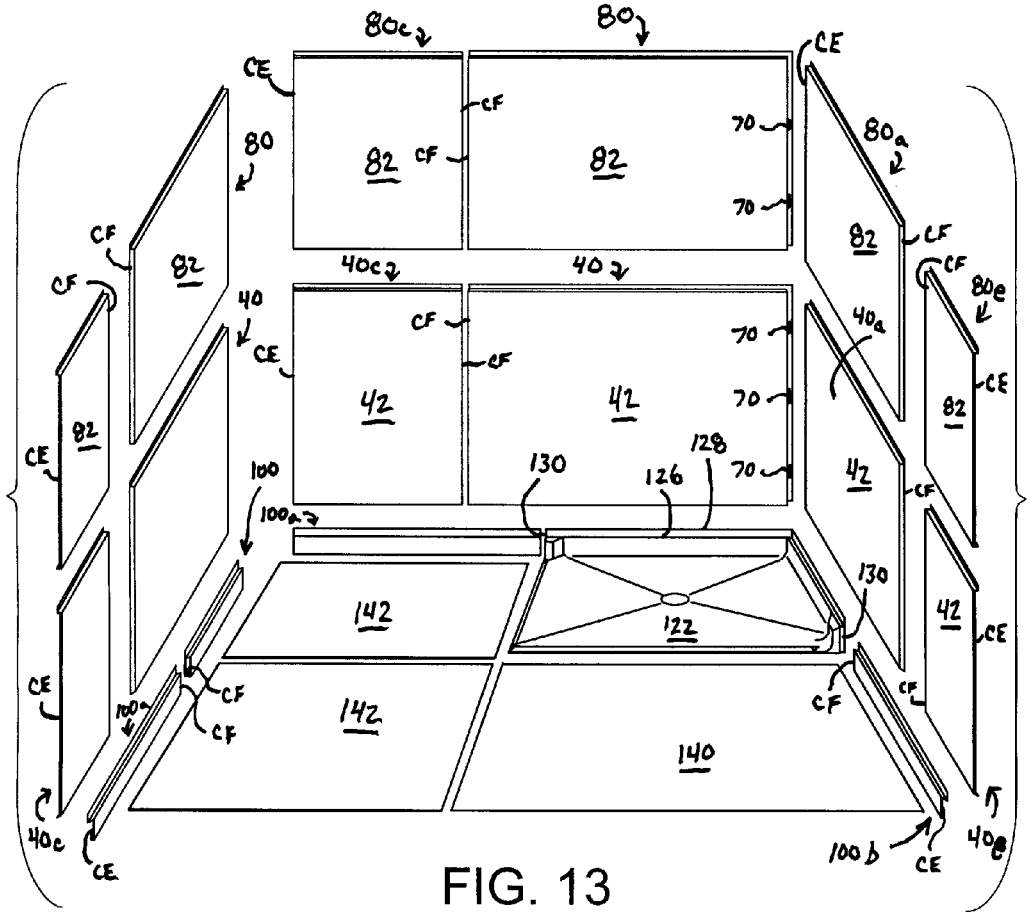
FIG. 13 is a partial, exploded perspective view of a UniWall™ and UniFloor™ system selectively having a shower pan 122, a plurality of floor panels 140, 142, and a plurality of floor ledge members 100, 100*a*, 100*b*; showing a plurality of lower wall panels 40, 40*a*, 40*c*, 40*e*, a plurality of upper wall panels 80, 80*a*, 80*c*, 80*e*, the wall panels and the floor ledge members are selectively cut by an installer at one or both ends during installation; the shower pan having a shower pan shelf 126, a shower pan mounting flange 128, and a pan ledge member receiving recess 130.
Figure 14:
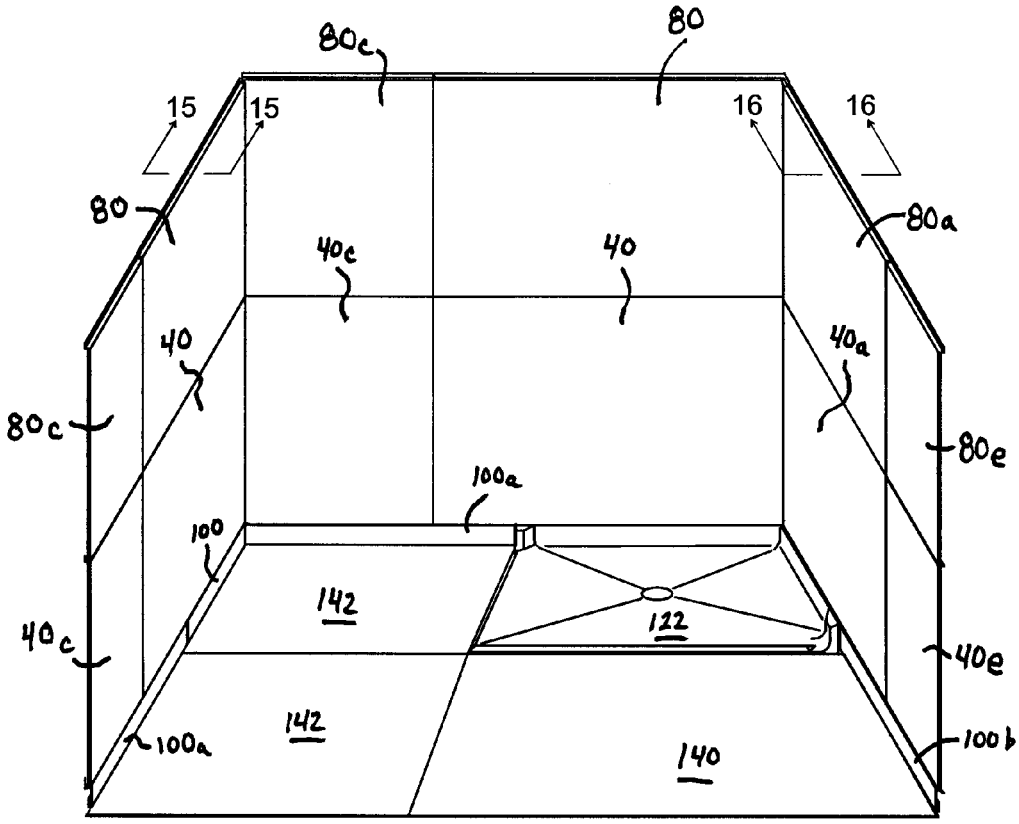
FIG. 14 is a partial perspective view of the UniWall™ and UniFloor™ system shown in FIG. 13 after assembly and installation in a room (room walls and a subfloor are not shown in interest of clarity of disclosure, but are to be understood respectively to be below the floor panels and the shower pan and behind the floor ledge members and the wall panels)
Figure 15:
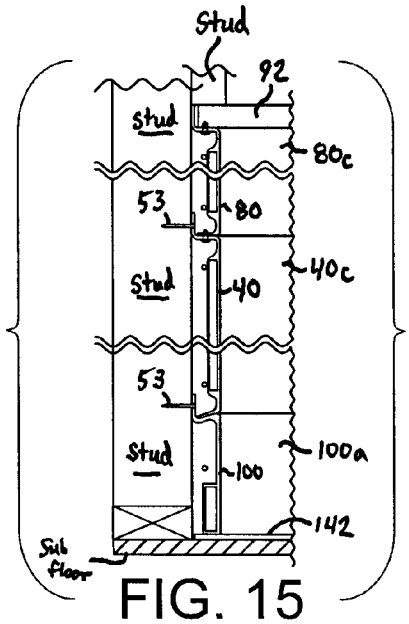
FIG. 15 is a partial cross-sectional view of the UniWall™ and UniFloor™ system shown in FIG. 14 as viewed in direction 15-15 showing the physical relationships between elements of the invention shown and showing a subfloor and a plurality of wall studs of the room in which the system is installed.
Figure 16:
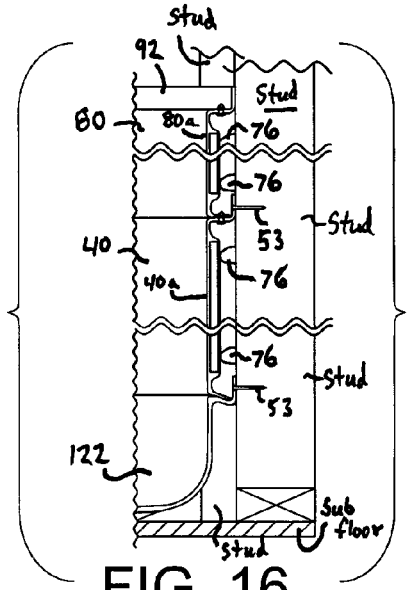
FIG. 16 is a partial cross-sectional view of the UniWall™ and UniFloor™ system shown in FIG. 14 as viewed in direction 16-16 showing the physical relationships between elements of the invention shown and showing a subfloor and a plurality of wall studs of the room in which the system is installed.
Figure 17:
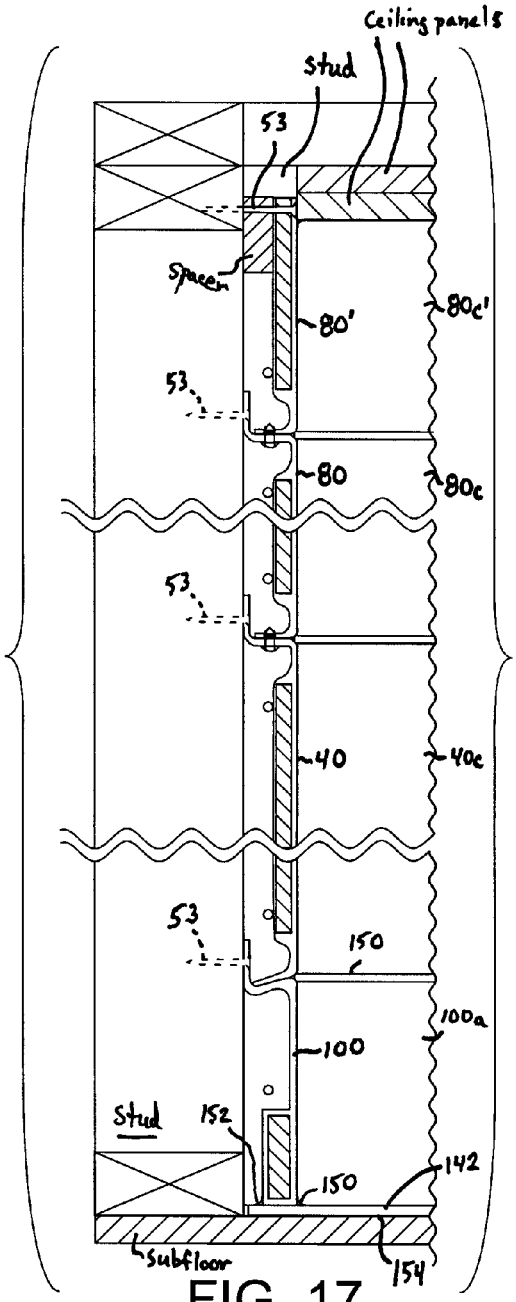
FIG. 17 is a partial cross-sectional view of the UniWall™ and UniFloor™ system shown in FIG. 14 showing a portion of an additional course of longitudinally cut upper wall panels 80', 80*c'* and two ceiling panels installed; and showing a plurality of end walls of wall panels, a plurality of studs, a plurality of primary joint seals 150 including a primary joint seal along the juncture between two ledge members 100, 100*a* and a floor panel 142; a secondary joint seal 152 behind the ledge member 100; and a location of an anchoring epoxy 154 between the bottom of the floor panel and a subfloor.
Figure 18:
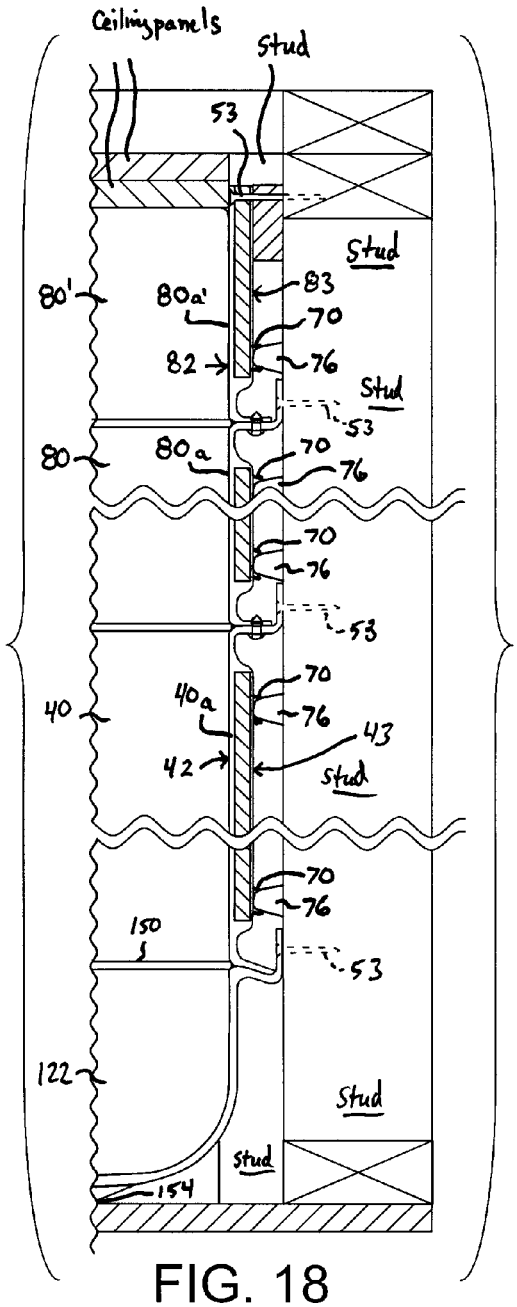
FIG. 18 is a partial cross-sectional view of the UniWall™ and UniFloor™ system shown in FIG. 14 showing a portion of an additional course of longitudinally cut upper wall panels 80*a'*, 80' and two ceiling panels installed; and showing a plurality of globs 76 of construction adhesive that have cured and fixed in a planar position a plurality of spring clips 70 (respectively fixed in position by and partially embedded in a plurality of globs 76 of construction adhesive); a plurality of studs, a plurality of primary joint seals 150, and a shower pan 122; and a placement of anchoring epoxy 154 between the bottom of the shower pan and a subfloor.
Figure 19:
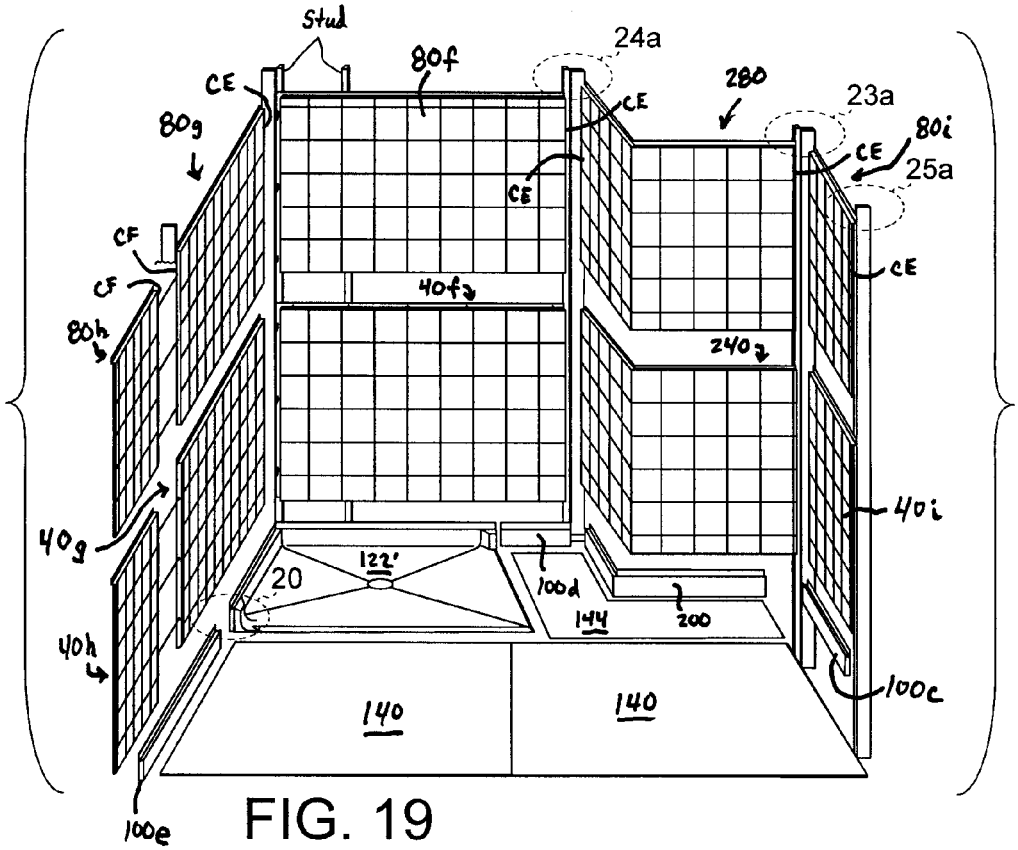
FIG. 19 is a partial, exploded perspective view of an alternative embodiment of a UniWall™ and UniFloor™ system in a room having an inside corner, the alternative embodiment having a shower pan 122'; a plurality of floor panels 140, 142; a plurality of floor ledge members 100*c*, 100*d*, 100*e*; a lower one-piece inside corner floor ledge member 200 having a ledge member shelf with the same cross-sectional profile across the shelf as the other floor ledge members, two cut end edges each respectively shaped to cooperate in abutting and joining a horizontally adjacent ledge member, and a ledge member top flange; a plurality of lower wall panels 40*f* to 40*i*; a lower one-piece inside corner wall panel 240 having the same cross-sectional profile as a lower wall panel, two cut end edges each respectively shaped to cooperate in abutting and joining a horizontally adjacent wall panel, and a top flange; a plurality of upper wall panels 80*f* to 80*i*; an upper one-piece inside corner wall panel 280 having the same cross-sectional profile as a upper wall panel, two cut end edges each respectively shaped to cooperate in abutting and joining a horizontally adjacent wall panel, and a top flange.
Figure 20:
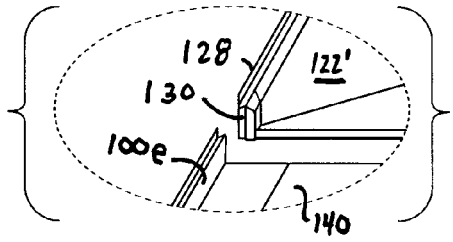
FIG. 20 is an enlarged perspective view of an indicated portion of FIG. 19.
Figure 21:
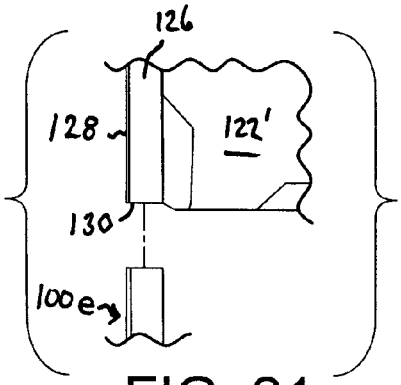
FIG. 21 is a partial, exploded top plan view of the indicated portion of FIG. 19 shown in FIG. 20 showing a cut flange end of a floor ledge member 100*e* directed by a lead line to an abutting relationship with a pan ledge member receiving recess 130.
Figure 22:
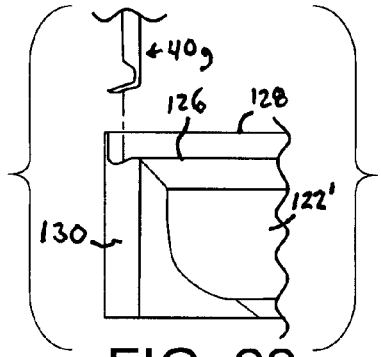
FIG. 22 is a partial, exploded side plan view of the indicated portion of FIG. 19 shown in FIG. 20 showing the bottom outer face of lower wall panel 40*g* directed by a lead line to an abutting relationship with a shower pan shelf 126.
Figure 23A:
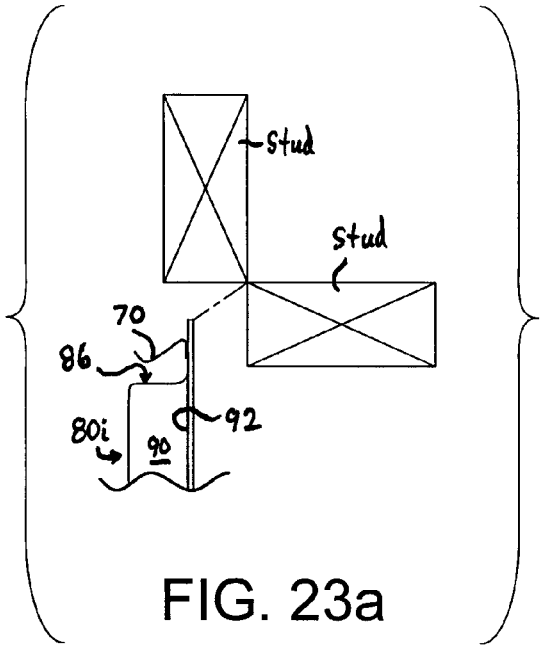
FIG. 23*a* is a partial, exploded top plan view of the indicated portion of FIG. 19.
Figure 23B:
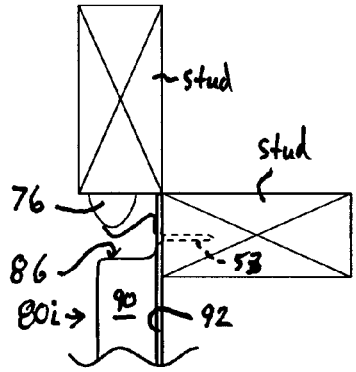
FIG. 23*b* is a partial, exploded top plan view of the indicated portion of FIG. 19 shown in FIG. 23*a;*
Figure 23C:
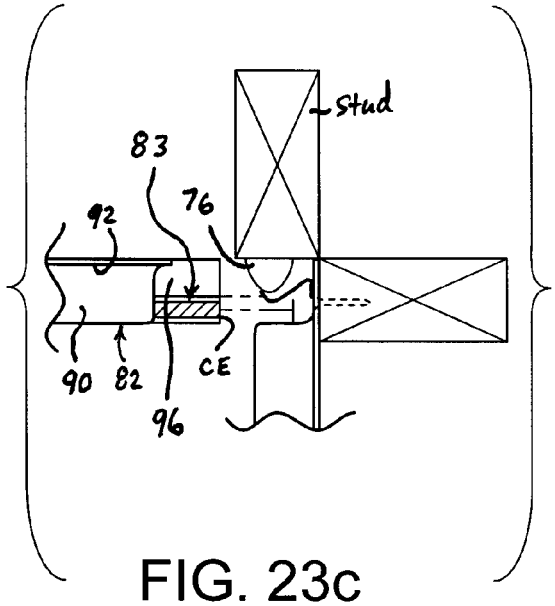
FIG. 23*c* is a partial, cutaway, exploded top plan view of the indicated portion of FIG. 19 shown in FIG. 23*a;*
Figure 23D:
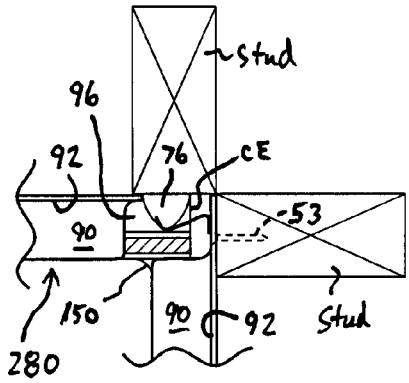
FIG. 23*d* is a partial, cutaway, top plan view of the indicated portion of FIG. 19 shown in FIG. 23*a;*
Figure 24A:
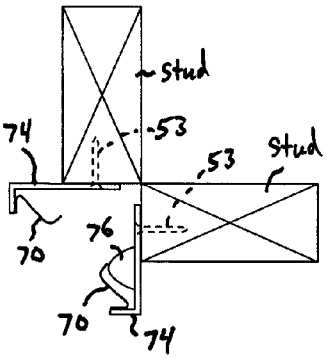
FIG. 24*a* is a partial, exploded top plan view of the indicated portion of FIG. 19.
Figure 24B:
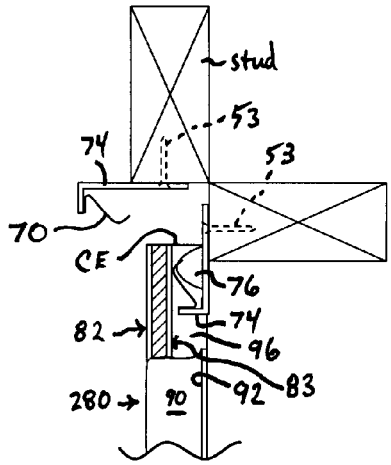
FIG. 24*b* is a partial, cutaway, exploded top plan view of the indicated portion of FIG. 19 shown in FIG. 24*a;*
Figure 24C:
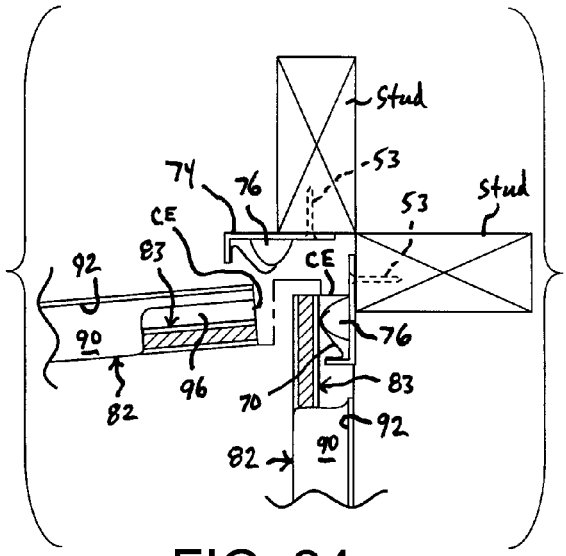
FIG. 24*c* is a partial, cutaway, exploded top plan view of the indicated portion of FIG. 19 shown in FIG. 24*a;*
Figure 24D:
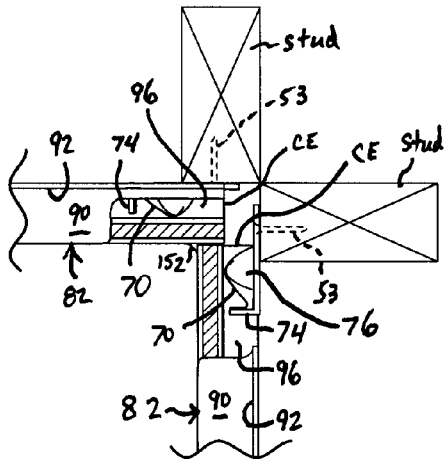
FIG. 24*d* is a partial, cutaway, top plan view of the indicated portion of FIG. 19 shown in FIG. 24*a;*
Figure 25A:
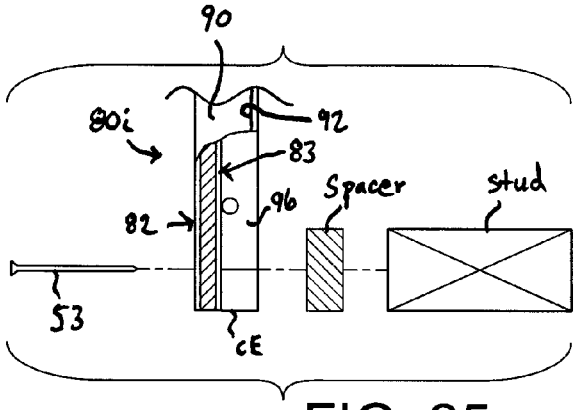
FIG. 25*a* is a partial, cutaway, exploded top plan view of the indicated portion of FIG. 19.
Figure 25B:
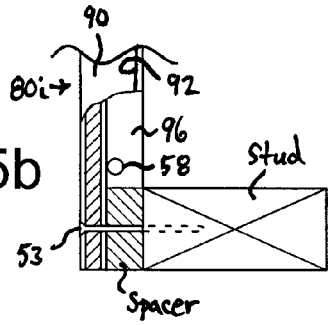
FIG. 25*b* is a partial, cutaway, top plan view of the indicated portion of FIG. 19 shown in FIG. 25*a;*
Figure 26:
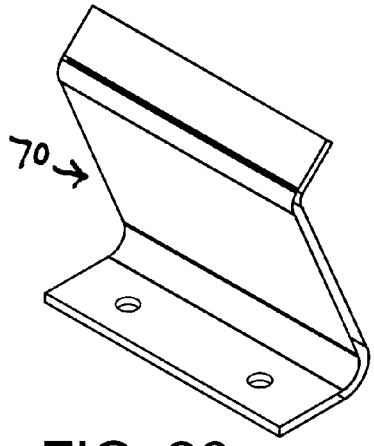
FIG. 26 is a perspective view from above of an S-shaped spring clip 70.
Figure 27:
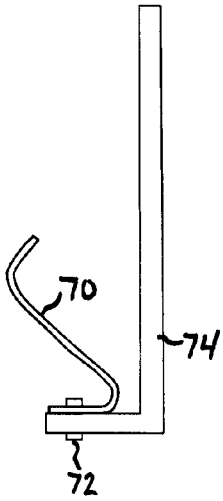
FIG. 27 is a side plan view of an S-shaped spring clip 70 mounted by a pop rivet 72 to an angled bracket 74.
Figure 28:
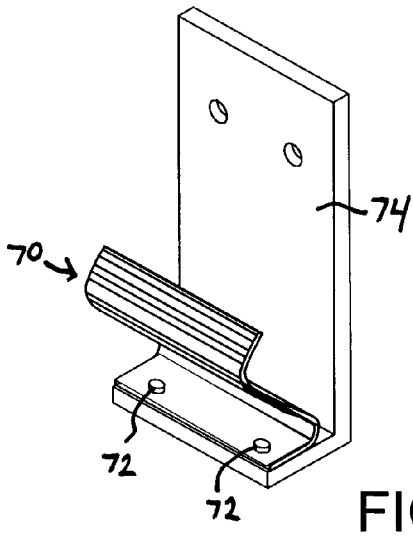
FIG. 28 is a perspective view from above of the S-shaped spring clip 70 and angled bracket 74 shown in FIG. 27.

FIGS. 13-14 show a shower pan 122 having a shower pan room perimeter mounting flange 126 and having a shower pan shelf 128 preferably angled to cooperate with a wall panel of the UniWall™ system.

When in an embodiment, a portion of the UniWall™ system rests on the shower pan shelf 126, in order to allow the lower wall panels to continue at the same elevation around the entire room, a plurality of floor ledge members 100, 100', 100*a*, 100*b* sections are installed around the room perimeter. The ledge members are similar to the wall panels and selectively may use a spring clip 70 and a glob 76 of construction adhesive in a room corner and panel retainers 60 along a room wall to attach one ledge member to an adjacent ledge member along a room wall or in a room corner. A floor ledge member abutting a shower pan 122 preferably is received in a close abutting relationship in a pan ledge member receiving recess 130.

The UniWall™ system invention requires principally mechanical fastening using a plurality of panel mounting screws 53, and selected aligning retainers 60 (can be nylon pins), a plurality of S-shaped spring clips 70, a plurality pop rivets 72, and a suitable construction adhesive 76 that can be a two-part anchoring epoxy adhesive that cures without significant shrinkage to a durable and generally rigid mass that can be reasonably used at most work environment temperatures.

The S-shaped spring clips 70 of the invention preferably are made of a flexible spring steel material that strongly resists flexing.

The joints between the panels, the pans and the ledge members of the various embodiments of the invention may be sealed with a two-component surfacing adhesive (preferably a methacrylate surfacing adhesive) that cures to a hard finish similar to the gel coat finish of the fiberglass panels.

Regarding a room subfloor over which the UniFloor™ system floor panels of the invention are to be installed, the floor panels of the invention are thicker and more rigid than a prior art linoleum floor and the floor panels can span gaps in the subfloor of as much as three inches without substantial deflection.

Resilient prior art floors such as a linoleum floor can easily dent when heavy objects are dropped on them; whereas, the UniFloor™ system incorporates generally thicker, more rugged floor panels that can absorb significant impact without significant degradation.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A method of use of a plurality of generally rectangular wall panels in a selected generally rectangular room having four room walls and a room doorway proximate a first room corner comprising the following steps:

(A) selecting and installing in said room a generally rectangular molded one-piece floor pan [20] floor assembly; said floor assembly having an outer perimeter having a doorway threshold [26] located proximate said first room corner and having a coplanar panel receiving shelf [30] proximate an inner perimeter of said room adjacent said room walls commencing proximate said first room corner and to the left of said doorway threshold and proceeding along all four sides of said inner perimeter and ending proximate to the right of said doorway;

(B) evaluating a first room wall to the left of said doorway threshold and determining a number of said wall panels [40] needed to provide a first wall course of wall panels serially end to end on said first room wall from said first room corner to a second room corner and when less than a full-length wall panel is needed;

(C) selecting a first wall panel having a left end having a left side flange and a right end having a right side flange and measuring for fit on said first room wall, the panel being too long for said first room wall, selectively transversely cutting said first wall panel left end to fit said first wall panel [40*d*] to said first room wall; said first wall panel having a first plurality of spring clips [70] attached to said right side flange [48] forming a first clamping gap; then placing said first wall panel in said panel receiving shelf positioned between said first room corner and said second room corner with said first plurality of spring clips proximate said second room corner and attaching said first wall panel attached with a plurality of panel mounting screws [53] to said first room wall;

(D) evaluating a second room wall to the right of said second room corner and determining a number of said wall panels needed to provide a second wall course of wall panels serially end to end on said second room wall from said second room corner to a third room corner and when approximately one and a third wall panels are needed;

(E) selecting a second wall panel and a third wall panel each said wall panel having a left end having a left side flange and a right end having a right side flange and measuring for fit on said second room wall; said two panels end to end being too long for said second room wall, selectively transversely cutting off said left side flange of said third wall panel to fit and said third wall panel [40] having a second plurality of spring clips attached to said third wall panel right side flange forming a second clamping gap; then placing said third wall panel in said panel receiving shelf positioned between said second room corner and said third room corner with said second plurality of spring clips proximate said third room corner and attaching said third wall panel with a plurality of panel mounting screws to said second room wall; transversely cutting off said right side flange of said second wall panel and selectively transversely cutting said left end of said second wall panel forming a second panel left cut edge to fit said second wall panel [40*c*] to said second room wall between said second room corner and said third wall panel;

(F) depositing a first plurality of globs [76] of construction adhesive operatively and respectively behind each of said first plurality of spring clips; then (G) placing said second wall panel in said panel receiving shelf with said second panel left cut edge positioned to cooperate and engage said first plurality of spring clips within said first clamping gap; and attaching said second wall panel positioned between said second room corner and said third wall panel with a plurality of panel mounting screws [53] to said second room wall;

(H) evaluating a third room wall to the right of said third room corner and determining a number of said wall panels needed to provide a third wall course of wall panels serially end to end on said third room wall from said third room corner to a fourth room corner, and when less than a full-length wall panel is needed;

(I) selecting a fourth wall panel having a left end having a left side flange and a right end having a right side flange and measuring for fit on said third room wall and said fourth wall panel being too long for said third room wall, selectively transversely cutting said fourth wall panel left end forming a fourth panel left cut edge to fit said fourth wall panel [40*b*] to said third room wall between said third room corner and said fourth room corner and said fourth wall panel having a third plurality of spring clips attached to said fourth wall panel right side flange forming a third clamping gap;

(J) depositing a second plurality of globs [76] of construction adhesive operatively and respectively behind each of said second plurality of spring clips; then (K) placing said fourth wall panel in said panel receiving shelf with said fourth panel left cut edge positioned to cooperate and engage said second plurality of spring clips within said second clamping gap; and attaching said fourth wall panel positioned between said third room corner and said fourth room corner with a plurality of panel mounting screws to said third room wall with said third clamping gap proximate said fourth room corner;

(L) evaluating a fourth room wall to the right of said fourth room corner and determining a number of said wall panels needed to provide a fourth wall course of wall panels serially end to end on said fourth room wall from said fourth room corner to a right side of said doorway, and when less than a full-length wall panel is needed;

(M) selecting a fifth wall panel having a left end having a left side flange and a right end having a right side flange and measuring for fit on said fourth room wall and said fifth wall panel being too long for said fourth room wall, selectively transversely cutting said fifth wall panel left end forming a fifth panel left cut edge to fit said fifth wall panel [40*a*] to said fourth room wall between said fourth room corner and said right side of said doorway;

(N) depositing a third plurality of globs [76] of construction adhesive operatively and respectively behind each of said third plurality of spring clips; then (O) placing said fifth wall panel in said panel receiving shelf with said fifth panel left cut edge positioned to cooperate and engage said third plurality of spring clips within said third clamping gap; and attaching said fifth wall panel positioned between said fourth room corner and said right side of said doorway; and (P) selectively repeating steps (B) through (P) regarding each additional course of wall panels selected to be installed in said room until a last wall panel of a last course of wall panels is attached to one of said room walls.

* * * * *